US005171942A

United States Patent [19]

Powers

[11] Patent Number: 5,171,942

[45] Date of Patent: Dec. 15, 1992

[54] OVAL SHAPED OVERHEAD CONDUCTOR AND METHOD FOR MAKING SAME

[75] Inventor: Wilber F. Powers, Coweta

[73] Assignee: Southwire Company, Carrollton, Ga.

[21] Appl. No.: 661,938

[22] Filed: Feb. 28, 1991

[51] Int. Cl.[5] ..... H01B 5/08; D07B 1/06

[52] U.S. Cl. ..... 174/129 R; 57/214; 57/215; 174/42

[58] Field of Search ..... 174/129 R, 42; 57/215, 57/214, 218, 219

[56] References Cited

U.S. PATENT DOCUMENTS

| | | | |
|---|---|---|---|
| 429,005 | 5/1890 | Bird | 57/215 |
| 1,955,024 | 4/1934 | Rohs | 174/129 S |
| 1,996,186 | 4/1935 | Affel | 174/129 R |
| 1,999,502 | 4/1935 | Hall | 174/129 R |
| 2,122,911 | 7/1938 | Hunter et al. | 57/9 |
| 2,135,800 | 11/1938 | Davignon | 57/215 |
| 2,156,652 | 5/1939 | Harris | 57/215 |
| 2,217,276 | 10/1940 | Hill et al. | 174/129 R |
| 2,620,618 | 12/1952 | Chamoux | 57/215 |
| 3,659,038 | 4/1972 | Shealy | 174/42 |
| 3,778,993 | 12/1973 | Glushko et al. | 57/145 |
| 3,916,083 | 10/1975 | Yakovlev et al. | 174/42 |
| 4,244,172 | 1/1981 | Glushko et al. | 57/215 |
| 4,436,954 | 3/1984 | Kaderjak et al. | 174/128 R |
| 4,605,819 | 8/1986 | Warburton | 174/129 R X |

FOREIGN PATENT DOCUMENTS

| | | | |
|---|---|---|---|
| 547101 | 8/1956 | Italy | 174/129 R |
| 125286 | 7/1957 | U.S.S.R. | 174/129 R |

*Primary Examiner*—Morris H. Nimmo

*Attorney, Agent, or Firm*—James W. Wallis, Jr.; Stanley L. Tate; George C. Myers, Jr.

[57] ABSTRACT

An oval or elliptical shaped overhead conductor that is twisted along its length to provide a continuously varying profile to the wind. A single core is comprised of a circular center wire wrapped by circular wires and the core is surrounded or encased by one or more layers of wire strands, including strands of different size from that of the core wires. Each layer is helically wound in a direction opposite to the underlying layers. The surrounding strands may be circular, with the strand sizes symmetrically arranged to result in a substantially oval or elliptical cross-section. Alternatively, the strands may be shaped into symmetrically arranged non-circular arcuate cross-sections, which when wound together result in an oval or elliptical conductor cross-section. The core strands are each circular or round wires having the same diameter, with the result that the core is easy and inexpensive to manufacture. The conductor is capable of manufacture in one step by winding the core and outer layers at the same time. A helical winding along the length of the conductor results in altering the profile that is presented to the wind, thereby substantially cancelling wind-induced forces in adjacent conductor segments or regions, thus damping conductor vibrations.

26 Claims, 2 Drawing Sheets

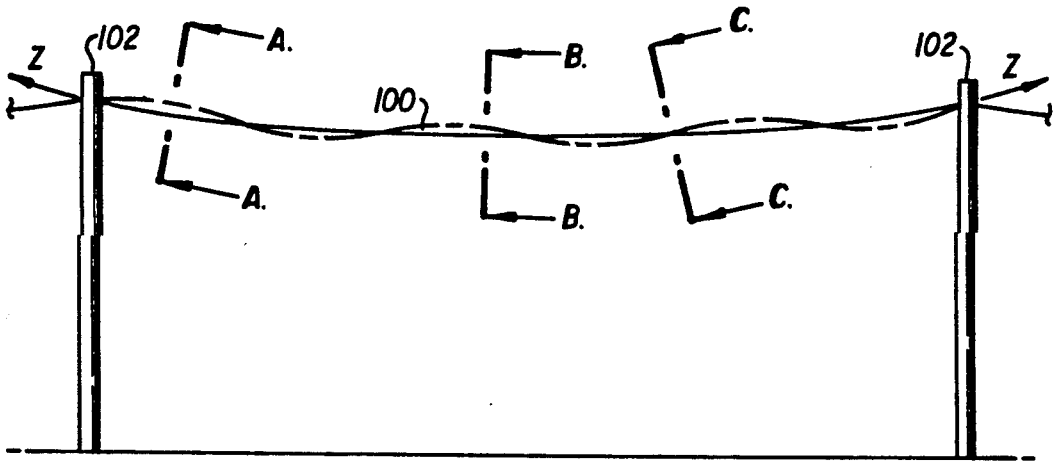
FIG. 1
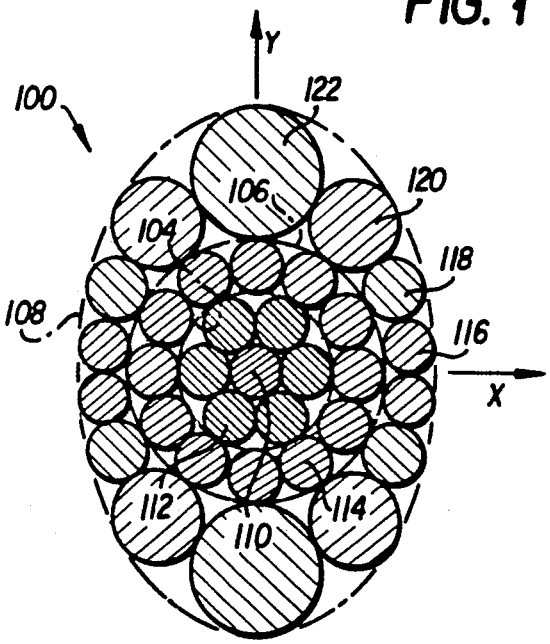
FIG. 2
FIG. 3
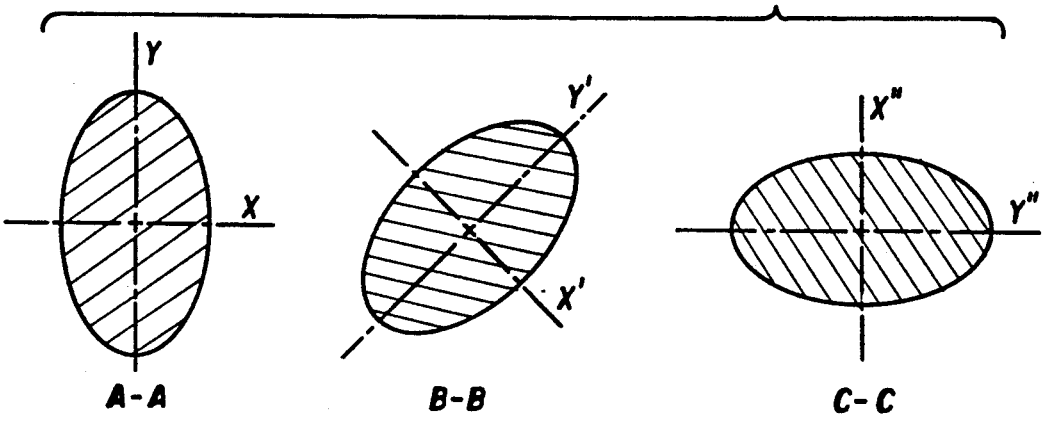

OVAL SHAPED OVERHEAD CONDUCTOR AND METHOD FOR MAKING SAME

FIELD OF THE INVENTION

The present invention relates to vibration-resistant uninsulated overhead conductors used for transmission lines.

DESCRIPTION OF THE PRIOR ART

Overhead electrical conductors used in transmission lines are known to be susceptible to wind-induced cable vibrations, because the conductors act as air foils for wind moving transversely to the conductor length. These wind-induced cable vibrations are generally of two types, aeolian vibrations and galloping vibrations.

In the case of aeolian vibrations, overhead cables exposed to the wind, at velocities corresponding to laminar flow conditions, shed vortices or eddies from the leeward side of the cable. These vortices alternate from the top edge of the cable to the bottom edge. The shedding of vortices by the cable results in alternating increased pressure in the area of the cable where the vortex is shed and lowered pressure in the area of the cable away from the shed vortex. This, in turn, results in a net force acting on the cable in the direction from higher pressure to lower pressure, causing the cable to move in the direction in which the force operates. Because vortices are shed alternately from the top and bottom of the cable, the net force acting on the cable also alternates, thereby causing the cable to move up and down.

Galloping forces are typically induced by high wind velocities corresponding to turbulent flow conditions. In galloping, wind blowing across a cable produces a force at the bottom of the cable which partially rotates the cable in one direction about its axis and also forces the cable in an arcuate path in a generally upward direction. This process is reversed at the top of the arcuate movement and the cable is driven downward. Thus, a sequence of combined rotative and arcuate movements results in a galloping motion of the cable. Galloping tends to be exacerbated by buildup of ice or snow on the cable.

The effects of wind driven aeolian and galloping forces on a cable installed between transmission towers result in vibrational damage to the cable over time. Therefore, in an effort to overcome these forces, cable designs have been made which are intended to be self-damping, either by altering the mechanical or aerodynamic characteristics of the cable. The mechanical properties of a cable can be changed, for example, by adding weights to the cable. Alternatively, such self-damping by altering the cable aerodynamics is achieved by providing a cable having a transverse profile which varies the angle of attack of the wind relative to the profile along the length of the cable. The wind forces in adjacent segments of the conductor tend thereby to act in opposing directions, thereby cancelling each other causing the vibrations to damp out. This is typically accomplished by providing a cable having a non-circular transverse cross-section and twisting or spiraling the cable along its longitudinal axis.

Exemplary of a combination of the mechanical and aerodynamic approach is U.S. Pat. No. 3,916,083 to Yakovlev et al. which is directed to suppressing galloping in aerial conductors by providing an oval-shaped dual core conductor and attaching weights or mechanical devices to the conductor to alter the mechanical characteristics of the conductor. This approach has the unfavorable effect of increasing the weight loads on the conductor. Also, the dual core conductor complicates installation inasmuch as the tensile forces on both cores must be the same.

Alternatively, exemplary of the aerodynamic approach, are conductors having non-circular cross-section which provide a varying profile facing the wind along the length of the conductor. Examples of this approach include U.S. Pat. No. 1,999,502 to Hall, which is directed to an electrical conductor having a non-circular, regular polygon cross-section having a core, intermediate and outer layers of wires and spiraled along the length of the conductor to alter the profile exposed to the wind. The conductor core is comprised of wires of equal diameter, with six wires wrapped about a single center wire in a "six over one" arrangement. The regular polygon shape is formed by using an outer layer of wires comprising wires ranging in diameter from less than to greater than the core wire diameter, with the larger diameter wires being positioned at the vertices between the polygon sides. This profile, while varying along the length of the conductor, does not present as radical a profile as an oval profile. Furthermore, ice build-up on a conductor in the form of a regular polygon tends to diminish the variation of the profile along the length, because the relatively flat sides inherent in such a shape serve as platforms for the ice. This has two undesirable results. First, icing tends to enhance galloping. Secondly, the diminished profile variation along the length of the conductor reduces the self-damping effect.

U.S. Pat. No. 3,659,038 to Shealy discloses two vibration-resistant cable designs. One such design, commonly referred to in the art as "T-2" conductor, comprises two helically wound cores made up of circular wire strands. A second design, commonly referred to as "cabled oval" conductor comprises two cores, as in T-2, encased in one or more layers of circular wire strands wound about the cores. Both T-2 and cabled oval conductors have the disadvantage of requiring the two cores to be tensioned equally when the conductor is strung between transmission towers. This creates problems or complications for installation in the field. Also, because there are multiple cores, multiple manufacturing steps are required, with the cores being made individually by stranding in which one or more layers of wire are wound around a central wire or core of wires, then cabled about each other in which two or more strands of wire are twisted together and then encased.

Thus, attempts to address the wind-loading problem have resulted in conductors having added weight, conductors having large numbers of wires and less favorable aerodynamics, and conductors with more favorable aerodynamics but with complex manufacturing and installation problems. It is, therefore, desirable to provide a conductor design having an oval or elliptical cross-section transverse to the direction of the wind, with the angle of attack varied along the conductor length, and which facilitates manufacture and installation thereof.

SUMMARY OF THE INVENTION

The present invention is directed to a high-voltage air-insulated vibration resistant electric power transmission conductor and method for making the same. The invention takes advantage of the vibration resistance, described above, of an air foil having an elliptical cross-section as opposed to a regular polygon. The conductor of the invention is capable of manufacture in one step involving only stranding with no cabling required, and requires no special tensioning of the one core during installation in the field, because there is only one core, and requires fewer wires to form the desired configuration. The elliptical profile is achieved by stranding symmetrically arranged wires of various cross-sections, which are helically and tightly wound. This results in a twisting or spiralling of the wire along its length, with the result that the profile presented to the wind varies continuously along the length of the conductor. Furthermore, no weights are required to be added to the conductor to effect damping. In the embodiment having arcuately-shaped strands, described below, because interstitial voids are reduced or minimized, the ampacity per unit of conductor area is increased.

Employing wire stranding devices known in the art, the method of the invention includes the steps of: helically winding a plurality of second wires in a first direction about a center wire to form a core; and helically winding in a second direction, opposite to the first winding direction, a plurality of third wires about the core to form one or more outer layers, with each layer wound in a direction opposite to the underlying layer. The method includes selecting the wires to be wound such that the wire cross-sections vary and are symmetrically arranged. The method further comprises winding a center wire and six second wires which are of equal diameter and configured in a six over one arrangement. The method further includes selecting a plurality of third wires which are of circular transverse cross-section. The resulting conductor is of the aerodynamically preferred elliptical or oval cross-sectional shape and hence has a major axis corresponding to the long dimension and a minor axis corresponding to the short dimension. Hereinafter, the ratio of the conductor diameter along the major axis to the diameter along the minor axis shall be referred to as the aspect ratio. The method further includes the step of selecting a plurality of circular third wires each symmetrically arranged about the underlying core layer, with the transverse cross-sectional dimensions of the wires increasing from those nearest the minor axis to those nearest the major axis. Alternatively, the method includes winding one or more layers of arcuately shaped third wires about the core with the shaped wires having varying cross-sections and arranged symmetrically so as to provide a conductor of elliptical or oval shape. In either embodiment, because of the various size wires used and the winding of the wires, the resultant conductor is spiralled such that the oval or elliptical cross-section major and minor axes are rotated along the length of the conductor and thus provide an airfoil having a continuously varying profile along the length of the conductor.

Several embodiments of the conductors of the invention are disclosed herein. Each includes the inventive feature of a single core comprised of a circular center wire strand wrapped by circular wires, surrounded or enclosed by one or more layers of wire strands including strands of varying size, typically of equal or greater size from that of the core, with the strand size increasing in the direction from the minor axis to the major axis, thereby limiting the number of wires required. Each layer is helically wound in a direction opposite to the underlying layer. The surrounding strands may be circular, with the strand sizes symmetrically arranged to result in a substantially oval or elliptical cross-section, spiralled along the conductor length. Alternatively, the surrounding strands may be shaped into non-circular cross-sections of varying sizes and symmetrically arranged, which when wound together result in an oval or elliptical conductor cross-section. Such non-circular cross-sections include arcuate shaped wires of various cross-sections and widths which vary along the length of the arc. The core strands are each circular or round wires having essentially the same diameter, with the result that the core is relatively easy and inexpensive to manufacture. In either embodiment, the conductor is capable of manufacture in one step by winding the core and outer layers at the same time using stranding equipment known in the art. A helical winding along the length of the conductor results in the profile transverse to the conductor length that is presented to the wind being altered, with the result that forces acting on adjacent conductor regions or segments are substantially cancelled, thus damping or minimizing wind-induced vibrations.

With the foregoing and other advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 1 is a schematic side elevation view taken along a spiralled conductor of the present invention strung between two towers;

FIG. 2 is a transverse cross-sectional view of a first embodiment of the present invention;

FIGS. 3A-3C show the orientation of the major and minor axes of a conductor of the invention at sections 3A, 3B, and 3C of FIG. 1 along the length of the conductor;

DETAILED DESCRIPTION OF THE INVENTION

Figure 5:
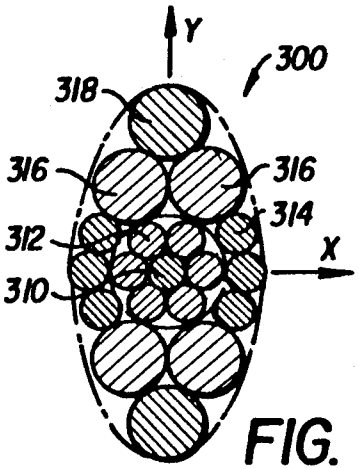
FIG. 5 is a transverse cross-section of a third embodiment of the present invention.

Referring now in detail to the drawings wherein like parts are designated by like reference numerals throughout, there is illustrated in FIG. 1 a side elevation view of a high voltage air-insulated and vibration resistant electric power transmission conductor according to the present invention, designated generally by the numeral 100, mounted between poles or towers 102.

FIG. 2 shows a first embodiment of the electrical conductor 100 according to the present invention which presents a generally elliptical or oval transverse cross-section. A core 104 (shown enclosed by broken lines) is formed by a central round wire 110 with six round wires 112 helically and tightly wound around wire 110. This is referred to as a "6 over 1" core. An intermediate layer 106 (shown enclosed by broken lines) of round wires 114 are helically and tightly wound about the core wires in the opposite direction from wires 112. An outer layer 108 (shown enclosed by broken lines) is wound about the intermediate layer in the opposite direction from that of the intermediate layer winding. This outer layer is formed from round wires 116, 118, 120 and 122 having four different diameters, ranging from approximately the same size as wires 114 for wires 116 to larger sizes for wires 118 and 120, up to the largest for wires 122. The resultant configuration is a transverse cross-section which is substantially elliptical or oval. This cross-section is aerodynamically preferred and in the embodiment of the invention is achieved with a reduced number of wires. The aspect ratio of this embodiment is approximately 3 to 2. For this embodiment, no small interstitial wires are needed between the intermediate layer and the outer layer in order to have a tightly wound conductor. Rather, the interior wires 112, 114 are of sufficient diameter to contact at least three other wires.

As shown in FIGS. 3A–3C, the spiralling or twisting of the conductor 100 along the longitudinal axis Z (FIG. 1) is illustrated by the rotation of the major and minor axes of an essentially elliptical or oval air foil, shown respectively as Y and X at section 3A—3A, Y′ and X′ at section 3B—3B and Y″ and X″ at section 3C—3C. Such a change in orientation results in a changing profile along the conductor length which is exposed to the wind. Thus, the different pressure forces, explained previously, which induce vibrations, tend to be cancelled or damped between adjacent segments of the conductor.

The conductor 100 of FIGS. 1 and 2 has the advantage that is can be manufactured in one step using a cabling apparatus adapted to feed and wind differently sized wires simultaneously.

Each of the additional embodiments and the method described below also includes the feature of spiralling or twisting of the conductor along the longitudinal axis, as explained for the first embodiment. These embodiments can also be manufactured in one step.

Figure 4:
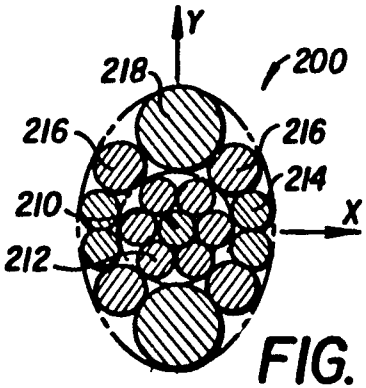
FIG. 4 is a transverse cross-section of a second embodiment of the present invention.

FIG. 4 shows a second embodiment of the invention, with a conductor 200 having a core of round wires 212 with a single center wire 210, surrounded by a single outer layer of wires 214, 216 and 218 of respectively increasing size. This arrangement of outer wires having increasing size in the direction from the minor axis X to the major axis Y results in a substantially oval or elliptical cross section. The resultant aspect ratio of dimensions along the major axis Y and minor axis X is approximately 3 to 2. No interstitial wires are used in this embodiment to fill any gaps between the core wires and outer wires. This embodiment has the advantage of not requiring the intermediate layer of wires, as shown in the first embodiment, as well as requiring a total of only 17 wires.

FIG. 5 shows a third embodiment of the invention with a conductor 300 having a core of round wires 312 wound about a central wire 310 surrounded by a single layer of outer wires 314, 316 and 318 of different sizes. Larger wires 316, 318 are arranged both at top and bottom in a triangular pitch. The aspect ratio of major axis Y dimension to minor axis X dimension is approximately 4 to 2. Again, no interstitial wires are used in this embodiment to fill any gaps between the core wires and outer wires. No intermediate layer of wires is required.

Figure 6:
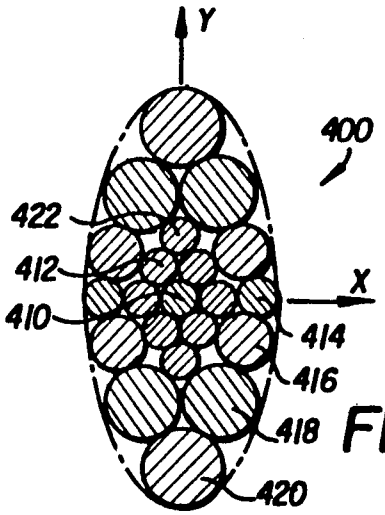
FIG. 6 is a transverse cross-section of a fourth embodiment of the present invention.

FIG. 6 shows a fourth embodiment of the invention, with a conductor 400 having a core of round wires 412 with a single center wire 410 surrounded by a single outer layer of round wires 414, 416, 418 and 420 of increasing size. Interstitial wires 422 are used to position the core wires 412 relative to outer wires 418 and fill the gap therebetween. Wires 418, 420 may be of substantially the same diameter. The aspect ratio of major axis Y dimension to minor axis X dimension is approximately 5 to 2. Again, no intermediate layer of wires is required.

Figure 7:
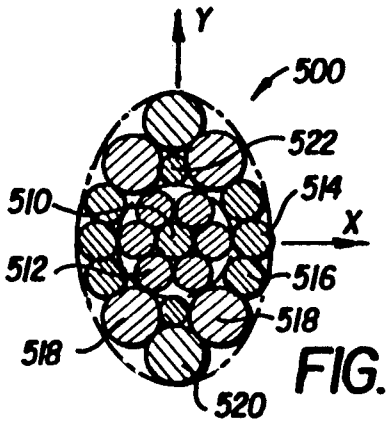
FIG. 7 is a transverse cross-section of a fifth embodiment of the present invention.

FIG. 7 shows a fifth embodiment of the invention, with a conductor 500 having a core of round wires 512 with a single center wire 510, surrounded by an outer layer of wires 514, 516, 518 and 520 of increasing diameter. Wires 518 and 520 may be of substantially the same diameter. A pair of interstitial wires 522 is employed to fill the gap between the core wires 514 and the outer layer wires 518, 520. The aspect ratio is approximately 8 to 5. No intermediate layer of wires is required between the core and outer layer of wires.

In the embodiments of FIGS. 4–7, as in FIG. 2, the essentially oval or elliptical cross-section is achieved using wires which range in size from essentially equal diameter of the central wire and core wires to wires having the greatest diameter being located at or near the end of the major axis. This results in the aerodynamically preferred shape requiring a minimum number of different size wires. Furthermore, because larger cross-section wires are used, fewer in total number are used. Depending on the sizes of the largest wires, the interstitial wires, for example, wire 522, FIG. 7, may be smaller than the center or core wires.

Figure 9:
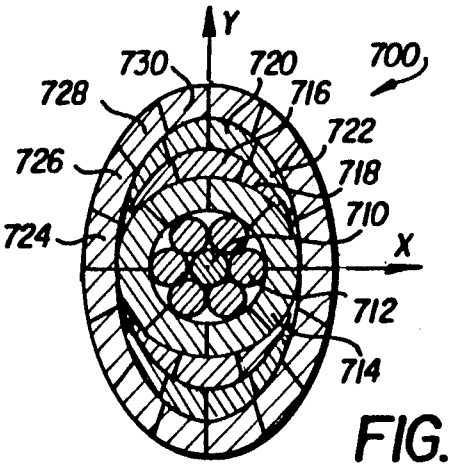
FIG. 9 is a transverse cross-section of a seventh embodiment of the present invention including shaped wire strands of non-circular cross-section.
Figure 8:
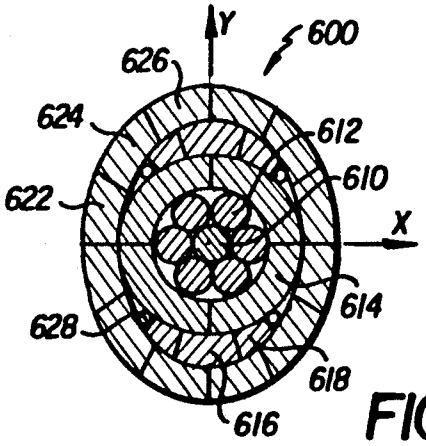
FIG. 8 is a transverse cross-section of a sixth embodiment of the present invention including shaped wire strands of non-circular cross-section.

FIGS. 8 and 9 illustrate sixth and seventh embodiments of the invention, respectively, using round core wires but with shaped strands to provide the oval or elliptically-shaped outer layer or layers. Shaped strands useful in such configurations are formed by methods and apparatus known in the art. Arcuately shaped strands are preferred, but other non-circular strands are contemplated. The embodiments of FIGS. 8 and 9 have the advantage of being very compact with minimal interstitial spacing between wires, thus increasing ampacity per unit conductor area. The arcuately shaped strands shown in FIGS. 8 and 9 range in shape and arc length from sectors of a circular ring, each having a uniform width, such as wires 614, FIG. 8, to convergent-divergent sectors having a narrower width at one end than at the other end of the sector. Intermediate between these two types of arcuate shapes are sectors from an essentially elliptical annulus, such as wires 616, 622, 624 and 626. These arcuate shapes combine symmetrically to form the desired elliptical air foil, with the profile varying along the length of the conductor. In FIG. 8, conductor 600 has a core of round wires 612 with a single center wire 610. Surrounding core wires 612 is a circular intermediate layer made up of arcuately shaped strands 614, a pair of arcuate sector layers made up of symmetrically arranged arcuately shaped strands 616 and 618 and interstitial round wires 628, which together provide an elliptical or oval shape. An elliptical outer layer is made up of symmetrically arranged arcuately shaped strands 622, 624, 626. The resultant aspect ratio is approximately 4 to 3.

Similarly, FIG. 9 shows conductor 700 comprised of a core of round wires 712 with a single round center wire 710, a circular layer of symmetrically arranged arcuately shaped strands 714, two arcuate sector intermediate layers made up of shaped strands 716 and 718 and 720 and 722, respectively, and an essentially elliptical outer layer of shaped strands 724, 726, 728, and 730. The arcuate sector layers and outer layer cooperate to provide an elliptical or oval shape. The resultant aspect ratio is approximately 11 to 7.

The materials which may be used for conductors of the type disclosed herein include all aluminum wires, all aluminum alloy wires, aluminum core wires with steel center wires (so-called "aluminum core steel reinforced conductor"), all copper wires or other suitable electrical conductor materials.

Employing wire stranding apparatus known in the art, the method of the invention includes the steps of: helically winding a plurality of second wires in a first direction about a center wire to form a core; and helically winding in a second direction, opposite to the first winding direction, a plurality of third wires about the core to form one or more outer layers. The method further comprises winding a center wire and second wires which are of equal diameter and configured in a six over one arrangement to form the core. The method includes selecting the wires to be wound such that the wire cross-sections vary and are symmetrically arranged. The method includes selecting a plurality of third wires which are of circular transverse cross-section. The resulting conductor is of elliptical or oval shape and hence has a major axis corresponding to the long dimension and a minor axis corresponding to the short dimension. The method further includes the step of selecting a plurality of third wires each symmetrically arranged about the underlying core layer, with the transverse cross-sectional dimensions of the wires increasing from those nearest the minor axis to those nearest the major axis. Alternatively, the method includes winding one or more layers of arcuately shaped third wires about the core with the shaped wires having varying cross-sections and arranged symmetrically so as to provide a conductor of elliptical or oval shape.

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A high voltage air-insulated vibration resistant electric power transmission conductor, having a length and a transverse cross-section, adapted to be suspended between towers spaced a predetermined distance apart, comprising:

a single core comprised of a plurality of helically and tightly wound wires, and a plurality of outer wires of various transverse cross-sections helically and tightly wound about said core, said outer wires symmetrically arranged so as to cooperate with said core to form a conductor having a uniform transverse cross-section that approximates an elliptical air foil that presents an essentially continuously varying profile along its length so as to substantially cancel wind-induced forces in adjacent conductor regions, thereby damping vibrations in said conductor.

2. An electric power transmission conductor as in claim 1, wherein said core has a uniform transverse cross-section approximating a circular shape.

3. An electric power transmission conductor as in claim 1, wherein said plurality of outer wires is further comprised of one or more overlaying layers, each said layer wound in a direction opposite to the layer it overlays.

4. An electric power transmission conductor as in claim 1, wherein said core wires are circular in transverse cross-section and have essentially the same diameter.

5. An electric power transmission conductor as in claim 4, wherein said core wires are arranged in a six over one configuration.

6. An electric power transmission conductor as in claim 1, wherein said outer wires are circular in transverse cross-section.

7. A high voltage air-insulated vibration resistant electric power transmission conductor, having a length and a transverse cross-section, adapted to be suspended between towers spaced a predetermined distance apart, comprising:

a single core comprised of a plurality of helically and tightly wound wires, and a plurality of arcuately-shaped outer wires of various transverse cross-sections and arc lengths helically and tightly wound about said core, said outer wires symmetrically arranged so as to cooperate with said core to form a conductor having a uniform transverse cross-section that approximates an elliptical air foil that presents an essentially continuously varying profile along its length so as to substantially cancel wind-induced forces in adjacent conductor regions, thereby damping vibrations in said conductor.

8. A high voltage air-insulated vibration resistant electric power transmission conductor, having a length and a transverse cross-section, adapted to be suspended between towers spaced a predetermined distance apart, comprising:

a single core comprised of a plurality of wires of circular cross-section helically and tightly wound together, and a plurality of arcuately-shaped outer wires of various transverse cross-sections and arc lengths symmetrically arranged and helically and tightly wound about said core so as to cooperate with said core to form a conductor having a uniform transverse cross-section that approximates an elliptical air foil that presents an essentially continuously varying profile along its length so as to substantially cancel wind-induced forces on adjacent conductor regions, thereby damping vibrations in said conductor.

9. A high voltage air-insulated vibration resistant electric power transmission conductor adapted to be suspended between towers spaced a predetermined distance apart, comprising:

(a) a single center wire;

(b) a plurality of second wires helically wound in a first direction about said center wire to form a core; and (c) a plurality of third wires helically wound about said core, said third wires forming one or more encasing layers around said core, said first encasing layer wound in a second direction about said core in a direction opposite to said first direction, any subsequent encasing layers wound in a direction opposite to said layer encased by said subsequent layer;

said plurality of layers forming an electrical conductor having an essentially elliptical transverse cross-section having a major axis and a minor axis, said major and minor axes spirally rotated along the length of said conductor, so as to present an essentially continuously varying profile along the conductor length thereby substantially cancelling wind-induced forces in adjacent conductor regions, thus damping vibrations in said conductor.

10. An electric power transmission conductor as in claim 9, wherein said single center wire and second wires are of essentially equal diameter and are arranged in a six over one configuration.

11. An electric power transmission conductor as in claim 9, wherein said center, second and third wires are each of circular transverse cross-section.

12. An electric power transmission conductor as in claim 11, wherein said third wires are symmetrically arranged around said core and have different dimensions ranging in diameter essentially equal to the diameter of said core wires for wires located near the minor axis of said conductor to a greatest diameter for wires located near the major axis of said conductor.

13. An electric power transmission conductor as in claim 9, wherein said third wires are of non-circular cross-section.

14. An electric power transmission conductor as in claim 9, wherein said center, second and third wires each have cross-sections which render said wires capable of being wound simultaneously.

15. An electric power transmission conductor as in claim 9, wherein one or more interstitial wires are disposed between said second wires and said third wires.

16. An electric power transmission conductor as in claim 13, wherein said non-circular wires have cross-sections which are arcuate sectors, said arcuate sectors arranged symmetrically to form one or more layers which comprise a conductor having said essentially elliptical transverse cross-section.

17. An electric power transmission conductor as in claim 16, wherein one or more interstitial wires of circular cross-section are disposed within interstices between said arcuate sectors.

18. A method of making a high voltage air-insulated vibration resistant electric power transmission conductor adapted to be suspended between towers spaced a predetermined distance apart, comprising the steps of:

(a) winding in helical fashion in a first direction a plurality of first wires about a center wire to form a core;

(b) winding in a helical fashion in a second direction opposite to said first direction a plurality of symmetrically arranged second wires about said core, said second wires having varying cross-sectional dimensions, said cross-sectional dimensions increasing in one direction corresponding to a major axis perpendicular to another direction corresponding to a minor axis, thereby forming a conductor of essentially elliptical cross-section.

19. A method as in claim 18, wherein said winding steps are performed simultaneously.

20. A method as in claim 18, further comprising the step (b) of winding in helical fashion in a first direction a plurality of first wires about a center wire having a circular cross-section.

21. A method as in claim 18, further comprising the step (b) of winding in helical fashion in a first direction a plurality of first wires each having a circular cross-section about a center wire to form a core.

22. A method as in claim 18, further comprising the step (b) of winding second wires each having a circular cross-section.

23. A method as in claim 18, further comprising the step of winding one or more additional plurality of wires around said second wires in a direction opposite to said second direction.

24. A method of making a high voltage air-insulated vibration resistant electric power transmission conductor adapted to be suspended between towers spaced a predetermined distance apart, comprising the steps of:

(a) winding in helical fashion in a first direction a plurality of first wires about a center wire to form a core;

(b) winding in a helical fashion in a second direction opposite to said first direction a plurality of symmetrically arranged second wires each having a non-circular cross-section about said core, said cross-sectional dimensions increasing in one direction corresponding to a major axis perpendicular to another direction corresponding to a minor axis;

(c) arranging said second wires symmetrically around said core, thereby forming a conductor of essentially elliptical cross-section.

25. A method as in claim 24, further comprising the step (b) of winding non-circular wires having cross-sections which are arcuately shaped.

26. A method of making a high voltage air-insulated vibration resistant electric power transmission conductor adapted to be suspended between towers spaced a predetermined distance apart, comprising the steps of:

(a) winding in helical fashion in a first direction a plurality of first wires about a center wire to form a core;

(b) winding in a helical fashion in a second direction opposite to said first direction a plurality of symmetrically arranged second wires about said core, said second wires having varying cross-sectional dimensions, said cross-sectional dimensions increasing in one direction corresponding to a major axis perpendicular to another direction corresponding to a minor axis;

(c) winding one or more additional plurality of non-circular wires around said second wires in a direction opposite to said second direction, thereby forming a conductor of essentially elliptical cross-section.

* * * * *